US005632598A

United States Patent [19]

Maier

[11] Patent Number: 5,632,598

[45] Date of Patent: May 27, 1997

[54] SHROUDED AXIAL FLOW TURBO MACHINE UTILIZING MULTIPLE LABRINTH SEALS

[75] Inventor: William C. Maier, West Almond, N.Y.

[73] Assignee: Dresser-Rand, Corning, N.Y.

[21] Appl. No.: 372,963

[22] Filed: Jan. 17, 1995

[51] Int. Cl.[6] ..... F01D 11/02

[52] U.S. Cl. ..... 415/173.5; 415/173.6

[58] Field of Search ..... 415/173.5, 173.6, 415/173.7, 174.5

[56] References Cited

U.S. PATENT DOCUMENTS

| | | | |
|---|---|---|---|
| 2,410,588 | 11/1946 | Phelan et al. . | |
| 2,772,854 | 12/1956 | Anoxionnaz | 416/190 |
| 2,910,269 | 10/1959 | Haworth et al. . | |
| 2,956,733 | 10/1960 | Stalker | 415/173.5 |
| 3,092,393 | 6/1963 | Morley et al. . | |
| 3,314,651 | 4/1967 | Beale | 415/173.6 |
| 3,575,523 | 4/1971 | Gross | 415/173.5 |
| 3,701,536 | 10/1972 | Matthews et al. . | |
| 3,730,640 | 5/1973 | Rice et al. | 415/173.6 |
| 3,867,060 | 2/1975 | Huber | 415/173.6 |
| 3,876,330 | 4/1975 | Pearson et al. . | |
| 3,897,169 | 7/1975 | Fowler | 415/173.6 |
| 4,057,362 | 11/1977 | Schwaebel | 415/173.6 |
| 4,273,510 | 6/1981 | Ambrosch et al. | 415/173.6 X |
| 4,534,701 | 8/1985 | Wisser . | |
| 4,662,820 | 5/1987 | Sasada et al. | 415/173.6 |
| 5,154,581 | 10/1992 | Borufka et al. | 415/173.6 |
| 5,232,338 | 8/1993 | Vincent de Paul et al. | 415/173.5 X |
| 5,238,368 | 8/1993 | Ortolano | 416/191 |
| 5,290,144 | 3/1994 | Kreitmeier | 415/173.6 |
| 5,439,347 | 8/1995 | Brandon | 415/173.5 X |

*Primary Examiner*—Edward K. Look
*Assistant Examiner*—Mark Sgantzos
*Attorney, Agent, or Firm*—Nixon, Hargrave, Devans & Doyle

[57] ABSTRACT

A turbo machine includes a plurality of rotor wheels mounted on and extending radially outward from a shaft to a radially outermost periphery. A shroud band for each rotor wheel has an inner and outer radial surface, with the inner radial surface secured to the radially outermost periphery of a plurality of buckets on each of the rotor wheels. The outer radial surface has a central portion displaced radially outward from upstream and downstream portions of the radial outward surface. A plurality of diaphragms are axially spaced from the rotor wheels and are configured to direct fluid against and effect rotation of the rotor wheel. An axial extension from each diaphragm surrounds and is spaced from the outer radial surface of the shroud band. First and second seal teeth extend radially inward from the axial extensions of each diaphragm and terminate at tips adjacent to the upstream and downstream portions, respectively. The tips of the first and second seal teeth extend radially inward of and are axially spaced from the central portion to form first and second non-contact axial seals, respectively. Each shroud band includes a pair of opposing sides between the inner and outer radial surfaces and may have at least one non-radial cut extending through the opposing sides, where the sides of the cut remain in contact during thermal expansion or contraction.

17 Claims, 14 Drawing Sheets

AREA SHOWN
IN DETAIL
FIGS. 2(a-d)
10
12
14
16
18
20
22
24
26
28
30
32
34
36
38
51
78
A
A

SHROUDED AXIAL FLOW TURBO MACHINE UTILIZING MULTIPLE LABRINTH SEALS

FIELD OF THE INVENTION

This invention relates generally to seals in a turbo machine and more particularly to blade-tip seals to control leakage of mainstream flow.

BACKGROUND OF THE INVENTION

Typically, a turbo machine includes a rotor that extends along and rotates about a central axis with one or more rotor wheels mounted on the rotor and extending radially outward from the central axis. A plurality of buckets or blades are attached to and evenly spaced around the periphery of each rotor wheel. A shroud band may be secured to the outermost radial tips of each bucket on each rotor wheel. A plurality of stator assemblies or diaphragms are also located in the turbine case and are axially spaced from the rotors and extend radially inward from the turbine casing. A plurality of nozzles are attached to and evenly spaced around each stator assembly or diaphragm to direct fluid against and effect rotation of the buckets with the main part of the fluid flowing axially from diaphragm to rotor wheel. Radially outward from the outer radial surface of each shroud band is a surface of either the turbine casing or a surface of an axial extension of the upstream diaphragm.

One of the problems with turbo machines is the leakage of mainstream fluid in the gap between the outer radial surface of the shroud band and the inner radial surface of the extension from each diaphragm. This gap is built-in to allow for thermal expansion of the rotor wheel, buckets, and shroud band and for rotational clearance to allow free rotation of the rotor assembly. Any fluid flow which is lost through these gaps is a loss of power and efficiency for the turbo machine.

Prior attempts to minimize this loss of power and efficiency have had limited success. Typically, most prior designs have focused upon improving non-contact radial sealing and have been less than adequate. Additionally, as noted earlier, there are limitations on how close the gap and thus how close the non-contact radial seals can be constructed because of thermal expansion and clearance requirements. Minor changes in the radial direction often can compromise the integrity of these prior non-contact radial seals. As a result, an unsatisfactory amount of fluid flow continues to be lost.

Another problem with turbo machines is in designing the machines to withstand the dimensional changes which occur due to thermal expansion without allowing mainstream flow to leak from the tips of the buckets. The shroud bands, which seal the top of the buckets, may not expand with heat at the same rate as the buckets. As a result, the shroud bands, buckets, and/or rotor wheels may be damaged when they expand or contract at different rates.

Prior systems have tried to compensate for the expansion by putting circumferentially arrayed gaps into the shroud band to allow the shroud band to expand freely as the machines heat up. Although these gaps compensate and permit expansion of the shroud band and buckets, the gaps are another source of mainstream flow leakage which is a loss of power and efficiency for the turbo machine.

Accordingly, there is a need for a turbo machine which can minimize loss of axial fluid flow and can tolerate, and to some extent, compensate for thermal expansion requirements.

SUMMARY OF THE INVENTION

A turbo machine in accordance with the present invention includes a shaft which extends along and rotates about a central axis. One or more rotor wheels are mounted on and extend radially outward from the central axis to a radially outermost periphery. A plurality of buckets are arranged circumferentially around each of said rotor wheels at the radially outermost periphery of each rotor wheel. A shroud band for each rotor wheel has an inner and outer radial surface, with the inner radial surface secured to the radially outermost periphery of the buckets on each rotor wheel. The outer radial surface of the shroud band has a central portion displaced radially outward from upstream and downstream portions on the radial outward surface. A stationary diaphragm or stator assembly is placed axially upstream of each rotor wheel. A plurality of nozzle passages are arrayed radially in each diaphragm, approximately in-line radially with the downstream buckets and evenly spaced circumferentially. The nozzles forming the nozzle passages in the diaphragms are configured to direct fluid against the buckets and effect rotation of the rotor wheel. An extension from each diaphragm surrounds and is radially spaced from the outer radial surface of each shroud band. First and second seal teeth extend radially inward from each extension and terminate at tips adjacent to the upstream and downstream portions of the shroud band. The tips of the first and second seal teeth are axially spaced from the central portion to form first and second non-contact axial seals, respectively. The turbo machine may also include a third seal tooth extending radially inward from each extension and terminating at a tip which extends radially inward of and axially spaced from a downstream edge of the shroud band to form a third non-contact axial seal. The turbo machine may include an upstream edge of the shroud band axially spaced from the diaphragm to form a fourth non-contact axial seal. Although four non-contact axial seals are described, the blade-tip seals can have any combination of two or more non-contact axial seals desired where at least two of the non-contact axial seals compensate each other for axially movement. Each shroud band may also have at least one non-radial cut between the inner and outer radial surfaces, where the sides of the cut remain in contact during thermal expansion or contraction.

The blade-tip seals in accordance with the invention substantially reduce fluid leakage through the gap between the outer radial surface of the shroud band and the inner radial surface of the extension from each diaphragm, thus increasing the power and efficiency of the turbo machine by using an effective combination of non-contact axial seals. The blade-tip seals are relatively insensitive to radial movements because relatively large radial clearances can be used which would have compromised prior non-contact radial seal designs. Further, the blade-tip seals are designed to be insensitive to axial movement by self-compensating to always provide at least one effective non-contact axial seal. Even further, the blade-tip seals are cost effective because no special or costly techniques must be used to manufacture or install the seals.

The shroud bands are also designed to adjust to thermal expansion and contraction requirements to prevent damage to the turbo machine. Each shroud band has at least one non-radial cut extending through opposing sides of the shroud band, which are between the inner and outer radial surface of the shroud band, to allow the shroud band to slide and/or compress along the cut during expansion and contraction. While the cuts permit expansion and/or contraction, contact is maintained at the sides of the cut.

BRIEF DESCRIPTION OF THE DRAWINGS

FIG. 2(*b*) is an enlarged cross-sectional view of a second embodiment of the blade-tip seals in the turbo machine shown in FIG. 1;

FIG. 2(*c*) is an enlarged cross-sectional view of a third embodiment of the blade-tip seals in the turbo machine shown in FIG. 1;

FIG. 2(*d*) is an enlarged cross-sectional view of a fourth embodiment of the blade-tip seals in the turbo machine in FIG. 1;

FIG. 3(*b*) is a top view of the shroud band being installed on the rivet of FIG. 3(*a*);

FIG. 3(*c*) is another cross-sectional view of a rotor wheel with buckets and with the shroud band being installed on the rivets of FIG. 3(*a*);

FIG. 3(*d*) is a cross-sectional view of the rivet pressed against the shroud band;

FIG. 3(*e*) is a top view of rivet pressed against the shroud band of FIG. 3(*d*);

FIG. 3(*f*) is another cross-sectional view of the rotor with buckets and with the rivets pressed against the shroud band of FIG. 3(*d*);

FIG. 3(*g*) is a cross-sectional view of the shroud band with an upstream and downstream portion cut into the shroud band;

FIG. 3(*h*) is a top view of the shroud band with the central, upstream, and downstream portion of FIG. 3(*g*);

FIG. 3(*i*) is a cross-sectional view of the rotor with buckets with the shroud band cut to have the central, upstream, and downstream portion of FIG. 3(*g*);

FIG. 4(*b*) is a partial top view of the first rotor embodiment in FIG. 4(*a*);

FIG. 4(*c*) is a partial cross-sectional view of the first rotor embodiment in FIG. 4(*a*) during thermal expansion;

FIG. 4(*d*) is a partial cross-sectional view of the first rotor embodiment in FIG. 4(*a*) during thermal contraction;

FIG. 4(*e*) is a partial cross-sectional view a second rotor embodiment with another non-radial cut through opposing sides of the shroud band;

FIG. 4(*f*) is a partial top view of the second rotor embodiment in FIG. 4(*e*);

FIG. 4(*g*) is a partial cross-sectional view of the second rotor embodiment in FIG. 4(*e*) during thermal expansion;

FIG. 4(*h*) is a partial top view of the second rotor embodiment of FIG. 4(*g*);

FIG. 4(*i*) is a partial cross-sectional view of the second rotor embodiment in FIG. 4(*e*) during thermal contraction; and FIG.4(*j*) is a partial top view of the second rotor embodiment in FIG. 4(*i*).

DETAILED DESCRIPTION OF THE INVENTION

Figure 1:
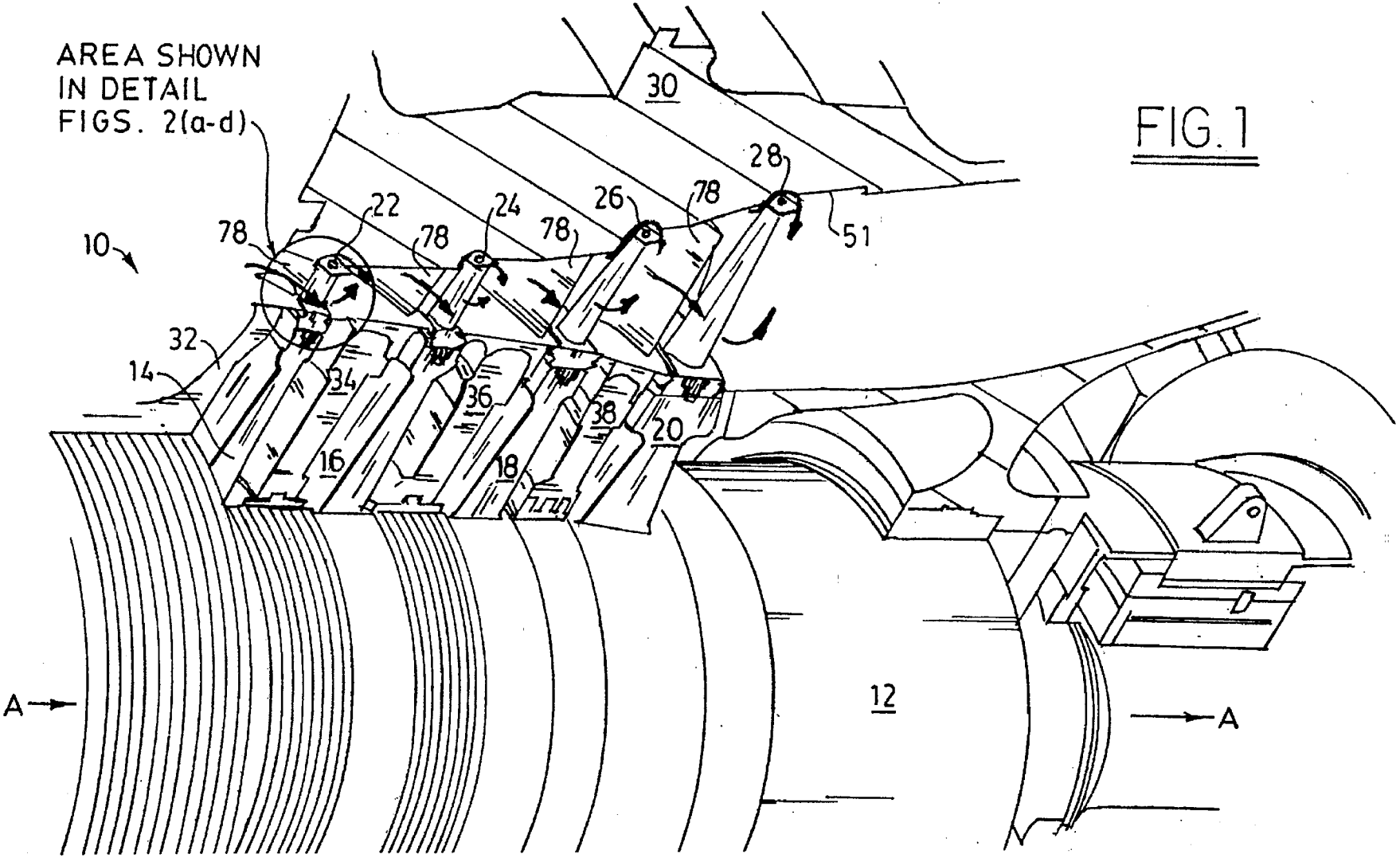
FIG. 1 is a cut-away, perspective view of an axial flow turbo machine with blade-tip seals in accordance with the present invention.
Figure 2A:
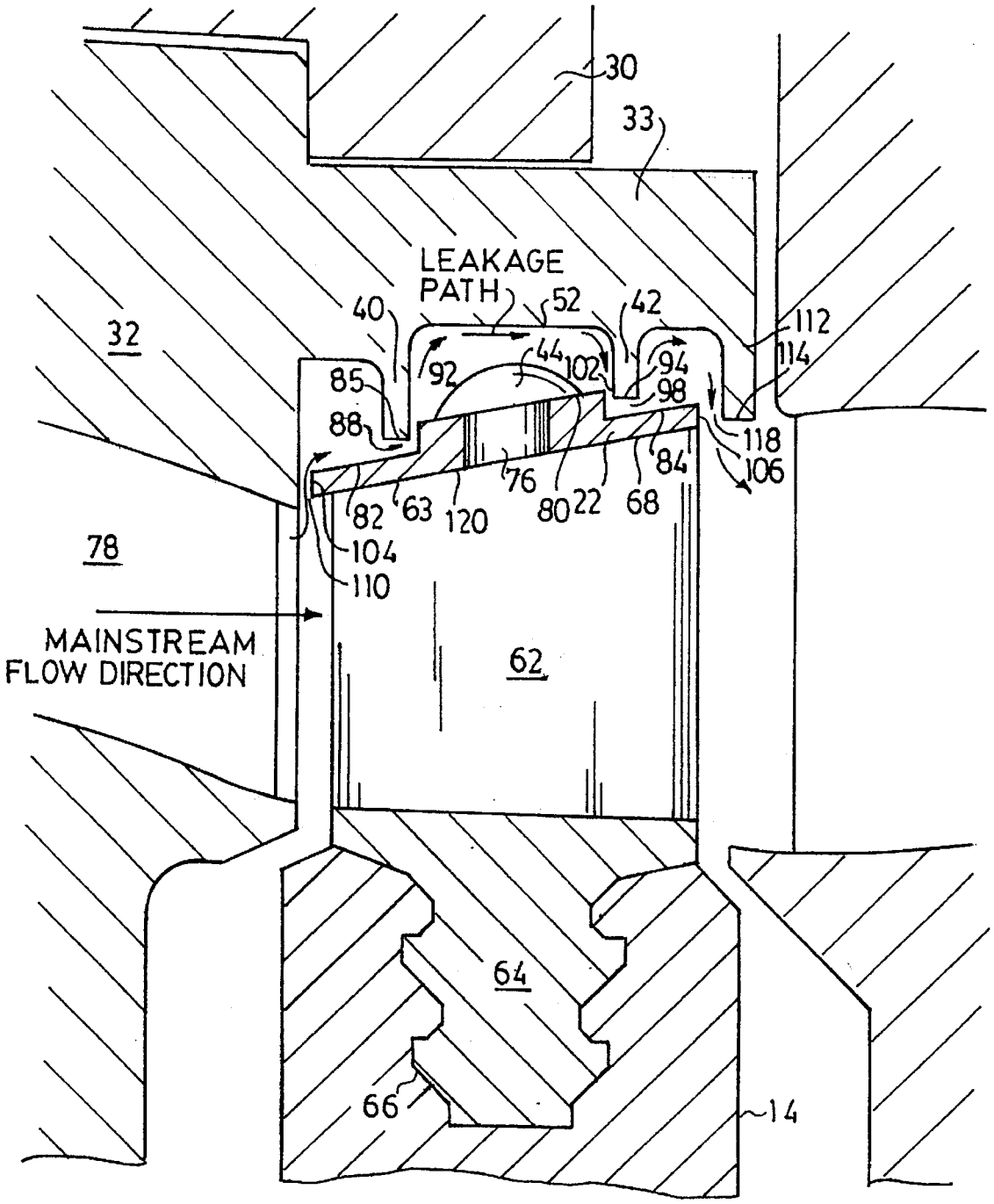
FIG. 2(*a*) is an enlarged cross-sectional view of one embodiment of the blade-tip seals in the turbo machine shown in FIG. 1.
Figure 2B:
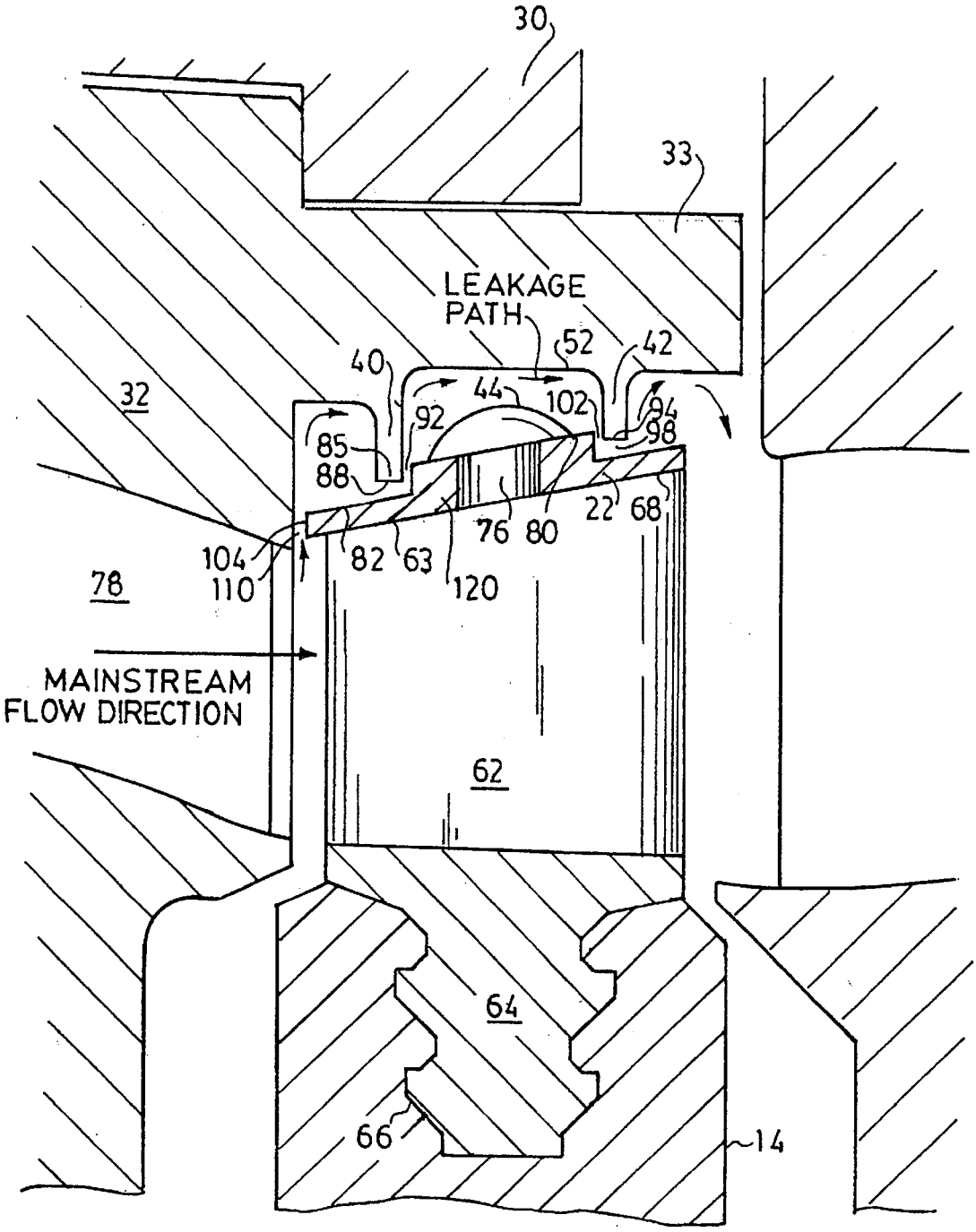
Figure 2C:
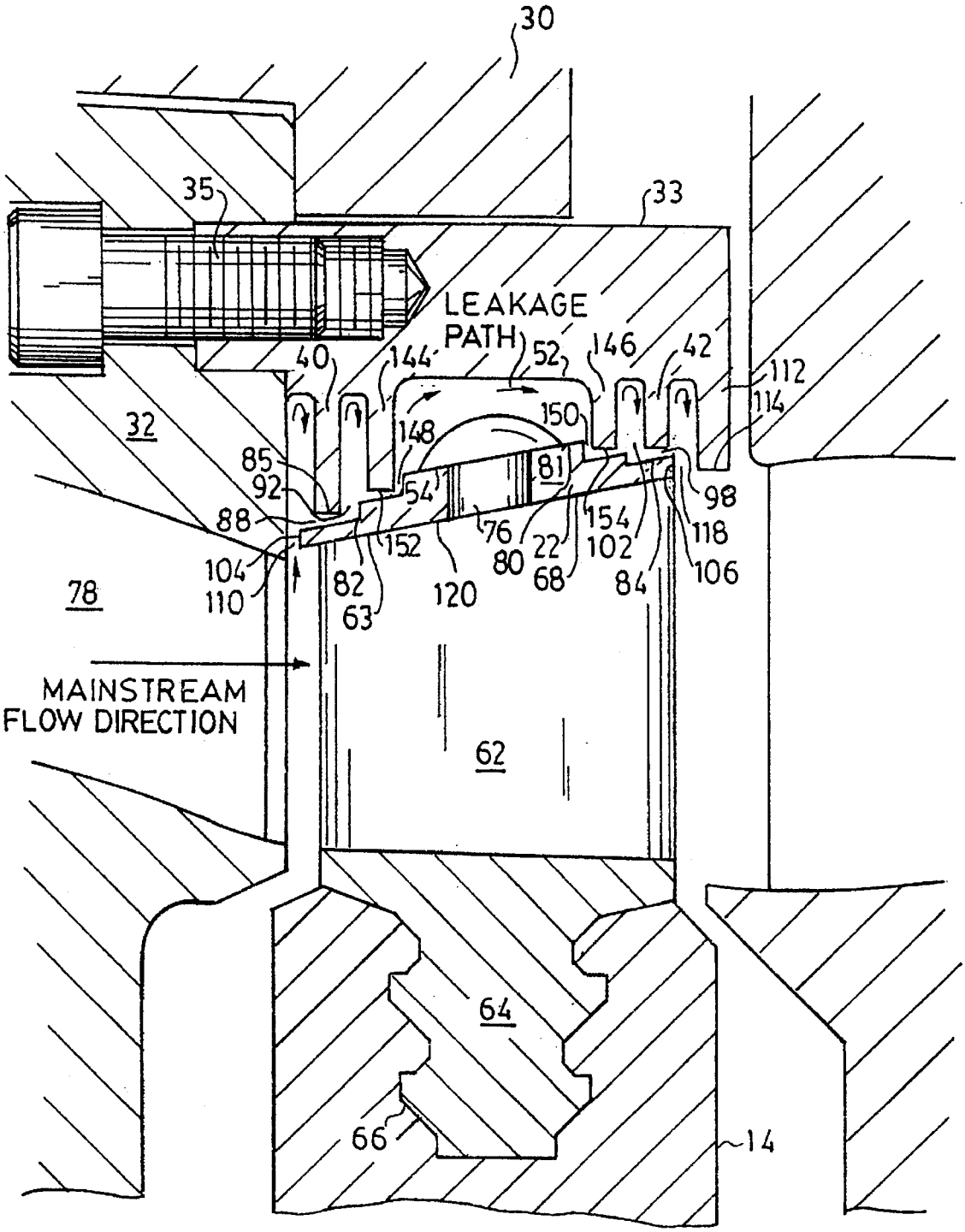
Figure 2D:
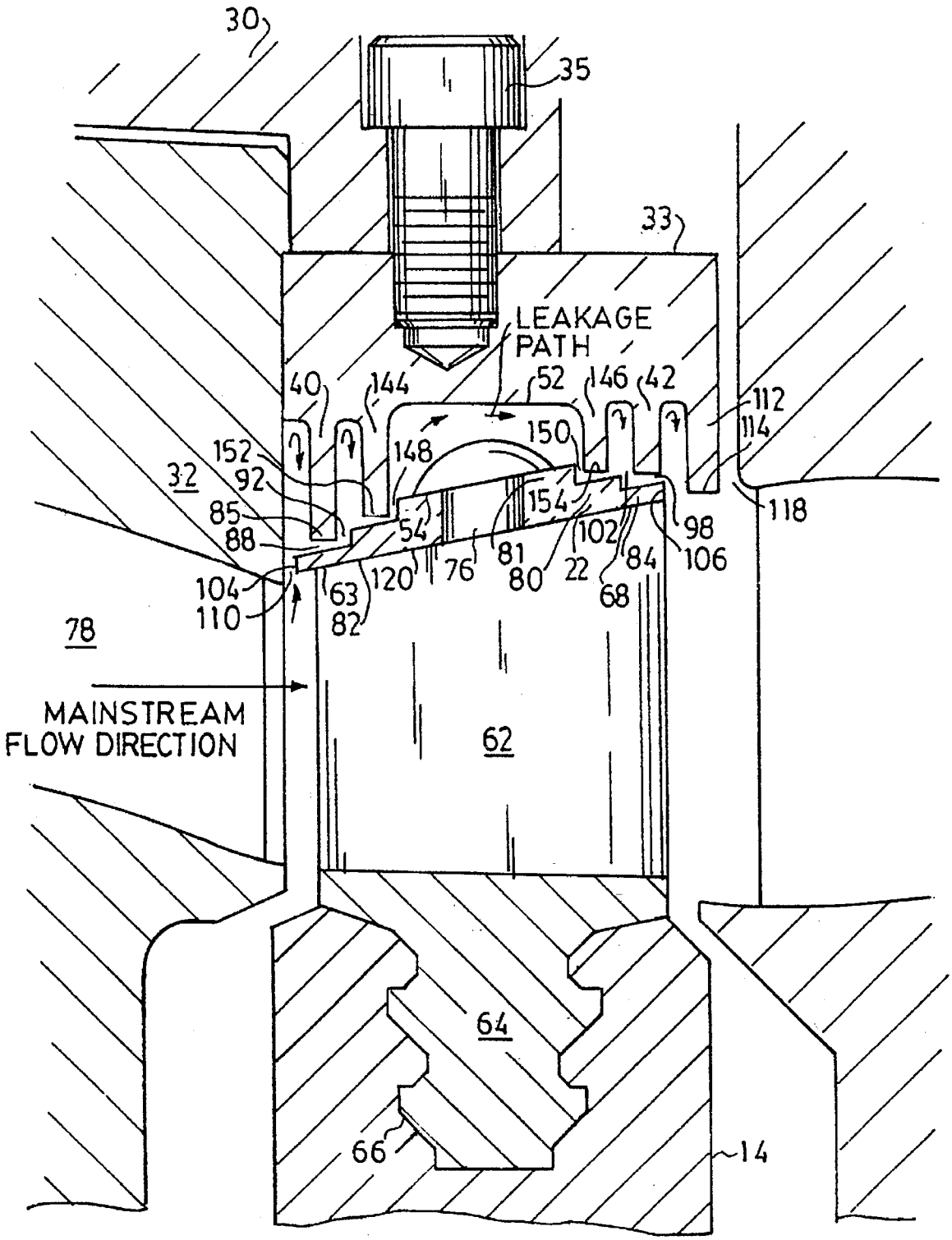

A turbo machine 10 in accordance with the present invention is illustrated in FIG. 1. The turbo machine 10 includes a rotor shaft 12 which extends along and rotates about a central axis A—A, rotor wheels 14, 16, 18, and 20, shroud bands 22, 24, 26, and 28, diaphragms or stator assemblies 32, 34, 36, and 38 and an outer casing 30. An enlarged view of a portion of the first stage of turbo machine 10 is illustrated in FIGS. 2(*a*–*d*) to illustrate in greater detail the present invention and resulting flowpath. Although only an enlarged view of a portion of the seal arrangement in the first stage of turbo machine 10 is illustrated, the seal arrangement for the remaining stages are the same as the first stage and thus are not illustrated.

Referring to FIG. 1, rotor wheels 14, 16, 18, and 20 are mounted on or machined into rotor shaft 12 and extend radially outward from rotor shaft 12. Shroud bands 22, 24, 26, and 28 are secured to the tips of rotor wheels 14, 16, 18, and 20. The outer casing 30 surrounds rotor wheels 14, 16, 18, and 20 with shroud bands 22, 24, 26, and 28 and keeps motive fluid in turbo machine 10. Diaphragms or stator assemblies 32, 34, 36, and 38 extend radially inward from outer casing 30 towards rotor shaft 12. Each diaphragm 32, 34, 36, and 38 is axially spaced from one rotor wheel 14, 16, 18, and 20. Although four stages of rotor wheels 14, 16, 18, and 20 and diaphragms 32, 34, 36, and 38 are shown, turbo machine 10 could have more or fewer stages if desired.

Referring to FIGS. 2(*a*–*d*), rotor wheel 14 includes a plurality of buckets or blades 62 which are attached to and spaced evenly around rotor wheel 14 with the outermost radial tip of each bucket 62 located along the radial outermost periphery of outer radial surface 63. As discussed earlier, the configuration of rotor wheels 16, 18, and 20 are the same as rotor wheel 14 and thus will not be repeated. Each bucket 62 has a curvilinear cross-section which is adapted to catch a passing axial fluid flow and to convert the axial fluid flow to rotary motion. In this particular embodiment, a root 64 for each bucket 62 fits within a matching groove 66 in rotor wheel 14, although other devices for attaching buckets 62 to rotor wheel 14 could be used. The particular size and number of buckets 62 on rotor wheel 14 can vary as needed and desired.

Shroud band 22 has outer radial surface 44 and inner radial surface 68. As discussed earlier, the configuration of shroud bands 24, 26, and 28 are the same as shroud band 22 and thus will not be repeated. Inner radial surface 68 is secured to the radially outermost tip 63 of each bucket 62 on rotor wheel 14. Rivets 76 secure shroud band 22 to the tips of buckets 62. Shroud band 22 could be secured to buckets 62 by other devices, such as being integrally machined with the buckets 62, cast with the buckets 62, welded to the buckets 62, bolted to the buckets 62, or mechanically fastened by other suitable means. Shroud band 22 seals the outer radial extent of fluid flow passage from buckets 62 by preventing mainstream fluid from escaping from the radially outermost tip 63 of each bucket 62. Shroud band 22 can be segmented into one or more pieces for rotor wheel 14 as described in greater detail later with reference to FIGS. 4(*a*–*j*).

Diaphragm or stator assembly 32 extends radially inward from inner radial surface 51 of outer casing 30 toward rotor shaft 12. As discussed earlier, the configuration of diaphragms or stator assemblies 34, 36, and 38 are the same as diaphragm or stator assembly 32 and thus will not be repeated. Diaphragm 32 has a plurality of stationary nozzles or stator blades 78 which are attached to and evenly spaced circumferentially around diaphragm 32. Nozzles 78 are configured and positioned to redirect the axial fluid flow into buckets 62 which convert the fluid flow into rotary motion. Diaphragm 32 includes an axial extension 33 which surrounds and is radially spaced from the outer radial surface 44 of shroud band 22. Axial extension 33 may be a part of diaphragm 32 as shown in FIG. 2(*a*), may be attached to diaphragm 32 by bolt 35 as shown in FIG. 2(*c*), may be attached to outer casing 30 by bolt 35 as shown in FIG. 2(*d*), or may be attached by any other suitable device or means.

The turbo machine 10 shown in FIGS. 1 and 2(*a–d*) operates when fluid flow, such as pressurized steam, passes through turbo machine 10 in the direction of the arrow A shown along central axis A—A. As the motive fluid passes along central axis A—A, the fluid impinges upon stationary nozzles 78 which accelerate and redirect the pressurized fluid into buckets 62. The accelerated fluid strikes buckets 62 which causes rotor wheel 14 to rotate driving rotor shaft 12.

Although most of the fluid flow is converted into rotary motion by buckets 62 a portion of the fluid flow will bypass each stage of buckets 62. This portion of the fluid flow leaks between outer radial surface 44 of shroud band 22 and inner radial surface 52 of extensions 33 bypassing buckets 62. The gap between shroud band 22 and extension 33 is needed to provide clearance for buckets 62 to rotate freely and to provide room for thermal expansion. This leak occurs at each stage of turbo machine 10.

Referring to FIG. 2(*a*), an enlarged view of the blade-tip seal system to minimize the loss of fluid flow is shown. Leakage minimization is accomplished by creating a tortuous path for fluid flow between inner radial surface 52 of extension 33 and outer radial surface 44 of shroud band 22 at one rotor wheel 14. The outer radial surface 44 of shroud band 22 has a central portion 80 displaced radially outward from upstream and downstream portions 82 and 84. The blade-tip seals in FIGS. 2(*b–d*) are the same as in FIG. 2(*a*), except as otherwise noted in the specification above and below.

First seal tooth 40 extends radially inward from inner radial surface 52 of extension 33 and terminates at a tip 85 adjacent to and separated from upstream portion 82 by a first radial distance 88. Tip 85 also extends radially inward of and axially spaced upstream from central portion 80 by a first axial distance to form a first non-contact axial seal or first axial baffle 92.

Second seal tooth 42 also extends radially inward from inner radial surface 52 of extension 33 and terminates at a tip 94 adjacent to and separated from downstream portion 84 by a second radial distance 98. Tip 94 also extends radially inward of and axially spaced downstream from central portion 80 by a second axial distance to form a second non-contact axial seal or second axial baffle 102.

Optionally, a third seal tooth 112 extends radially inward from inner radial surface 52 of extension 33 and terminates at a tip 114 which extends radially inward of and axially spaced downstream by a third axial distance from downstream edge 106 of shroud band 22 to form a third non-contact axial seal or third axial baffle 118. As shown in an alternative embodiment in FIG. 2(*b*), the third seal tooth 112 could be left off, leaving only first and second seal teeth 40 and 42. Without third seal tooth 112, there is no third non-contact axial seal or third axial baffle 118.

Shroud band 22 also has an upstream edge 104 axially spaced by a fourth axial distance downstream from diaphragm 32 to form a fourth non-contact axial seal or fourth axial baffle 110. Discharge of fluid from nozzles 78 is radially below upstream edge 104 of shroud band 22.

As shown in FIGS. 2(*c* and *d*), the blade-tip seals could include fourth and fifth seal teeth 144 and 146. Central portion 80 is machined on each side to create middle portion 81. Fourth seal tooth 144 extends radially inward from inner radial surface 52 and terminates at tip 152 adjacent to and separated from upstream portion 82. Tip 152 extends radially inward of and axially spaced upstream from middle portion 81 by a fifth axial distance to form a fifth non-contact axial seal or fifth axial baffle 148. Fifth seal tooth 146 extends radially inward from inner radial surface 52 and terminates at tip 154 adjacent to and separated from downstream portion 84. Tip 154 extends inward of and axially spaced downstream from middle portion 81 by a sixth axial distance to form a sixth non-contact axial seal or sixth axial baffle 150. As FIGS. 2(*b–d*) illustrate, blade-tip seals in accordance with this invention include any combination of two or more non-contact axial seals where at least two of the non-contact axial seals compensate each other for axially movement.

Accordingly, any fluid which tries to pass through the gap between outer radial surface 44 of shroud band 22 and inner radial surface 52 of extension 33 encounters a tortuous path, as shown by the arrows in FIGS. 2(*a–d*). In FIG. 2(*a*) first, second, third and fourth non-contact axial seals create a tortuous path, in FIG. 2(*b*) first, second, and fourth non-contact axial seals create a tortuous path and in FIGS. 2(*c–d*) first-sixth non-contact axial seals 92, 102, 110, 118, 148 and 150 create a tortuous path.

The seal configuration of this invention is more effective than previous designs due to use of a series of non-contact axial seals 92, 102, 110, 118, 148 and 150 and their unique orientation. Although four non-contact axial seals 92, 102, 110 and 118 are shown in FIG. 2(*a*), the invention includes other combinations of seals, such as two non-contact axial seals 92 and 102, three non-contact axial seals 92, 102, and 110 as shown in FIG. 2(*b*), or six non-contact axial seals, 92, 102, 110, 118, 148, and 150 as shown in FIGS. 2(*c* and *d*). The axial non-contact seals arrayed axially along the shroud outer radial surface 44, at non-constant radial positions, create a circuitous flow path with large flow turning. Because of the grossly varying cross sectional areas and abusive passage geometry created by the seals; this configuration of seals decreases the discharge coefficient of each seal gap and greatly enhances the dissipation of kinetic energy in the fluid jetting from each seal gap thus minimizing leakage flow for a given pressure drop imposed across the seal system.

The present invention is largely insensitive to radial motion between the rotating and stationary components because there is no dependence on small radial clearances. Instead, the invention relies upon non-contact axial seals, such as seals 92, 102, 110, and 118 in FIG. 2(*a*) in turbo machine 10 which are designed to be self-compensating for any movements in the axial direction. For example, in FIG. 2(*a*) any increase in the first and fourth axial distances for first and fourth non-contact axial seals 92 and 110 is compensated for by a decrease in the second and third axial distances for second and third non-contact axial seals 102 and 118, and vice-versa. Preferably, axial distances for the seal clearances are substantially the same and, in this particular embodiment, are typically in a range of 0.010 to 0.050 inches. Turbo machine 10 may also use non-contact radial seals or radial baffles in conjunction with upstream and downstream non-contact axial seals or axial baffles to create a more tortuous path for any fluid flow, thus further minimizing any loss.

Figure 3A:
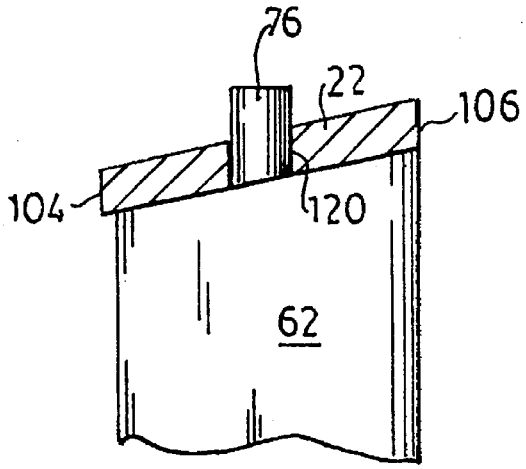
FIG. 3(*a*) is a cross-sectional view of a shroud band being installed on a rivet on a bucket taken along line 3*a*–3*b* of FIG. 1.
Figure 3B:
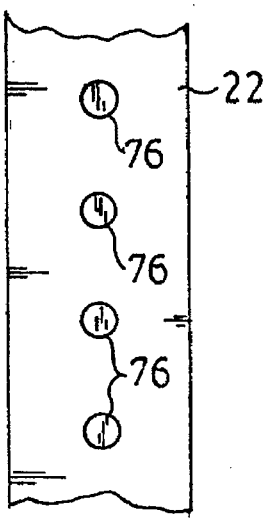
Figure 3C:
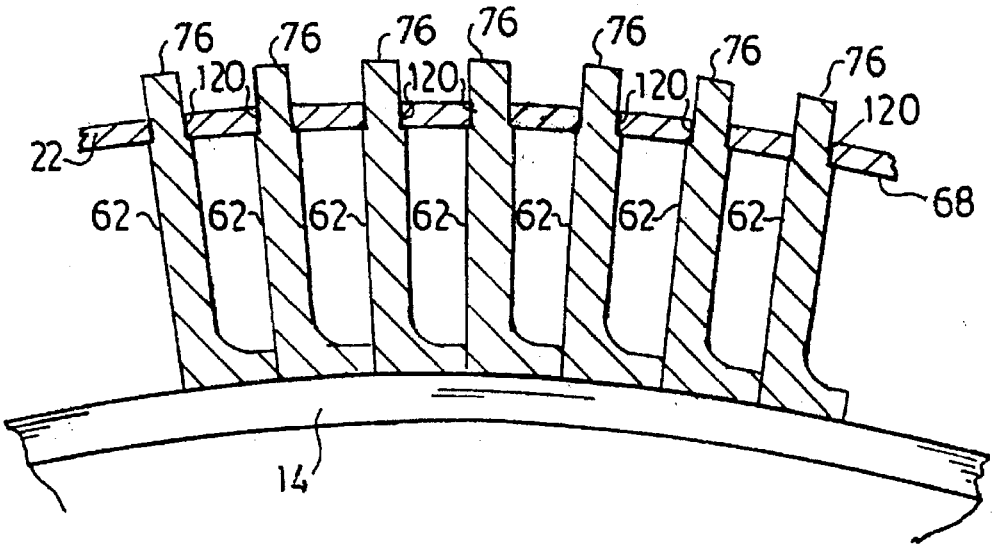
Figure 3D:
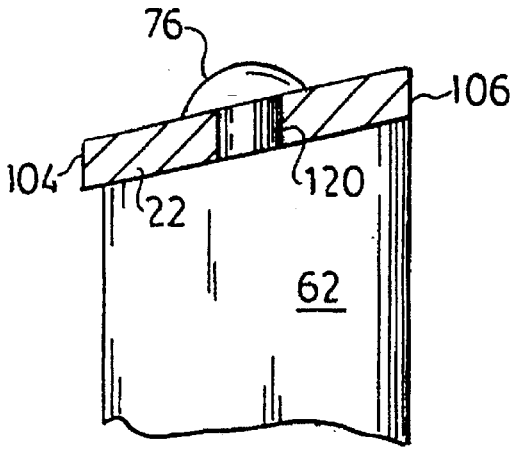
Figure 3E:
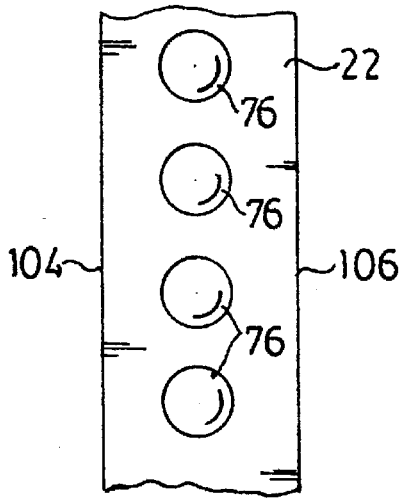
Figure 3F:
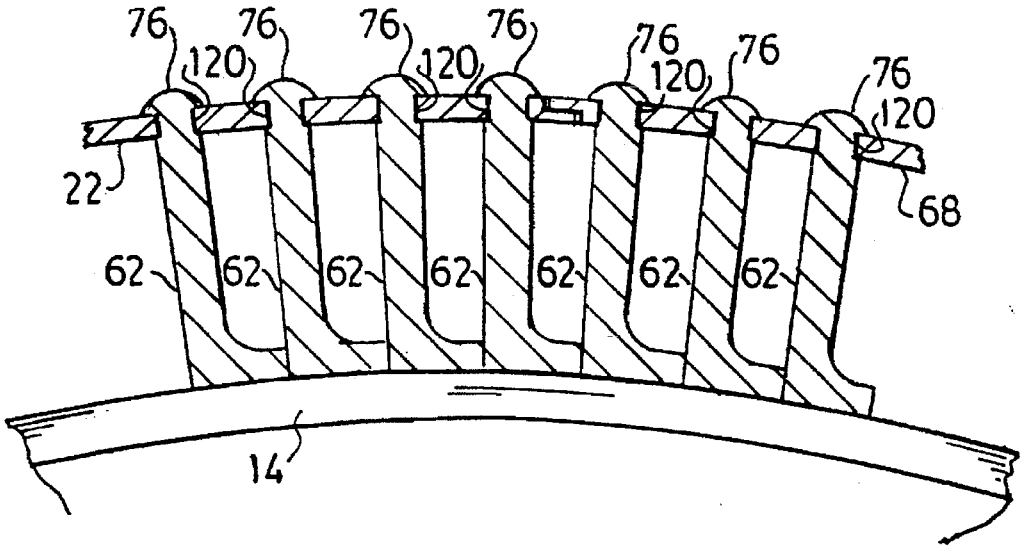
Figure 3:
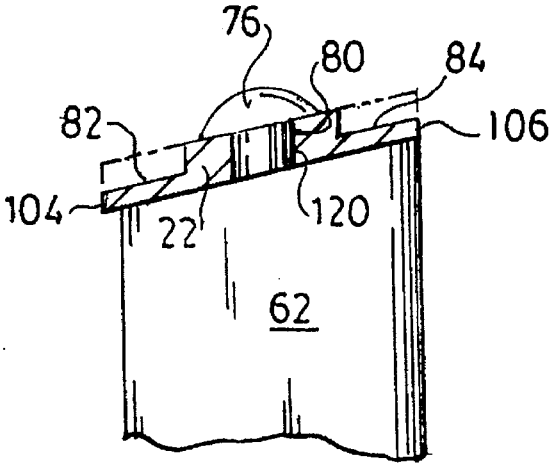
Figure 3:
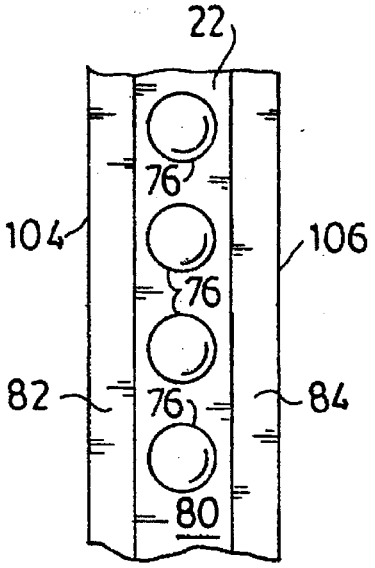
Figure 3I:
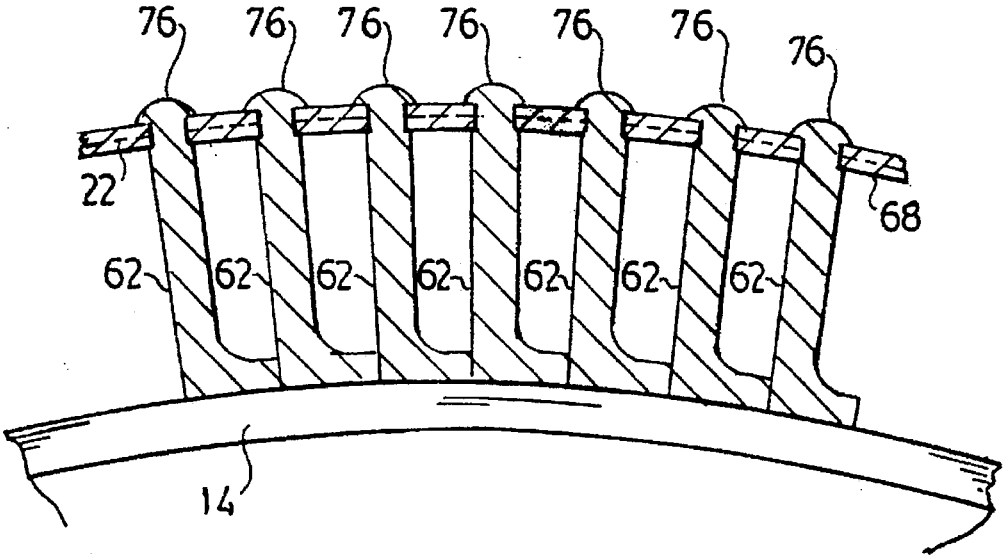
Figure 4A:
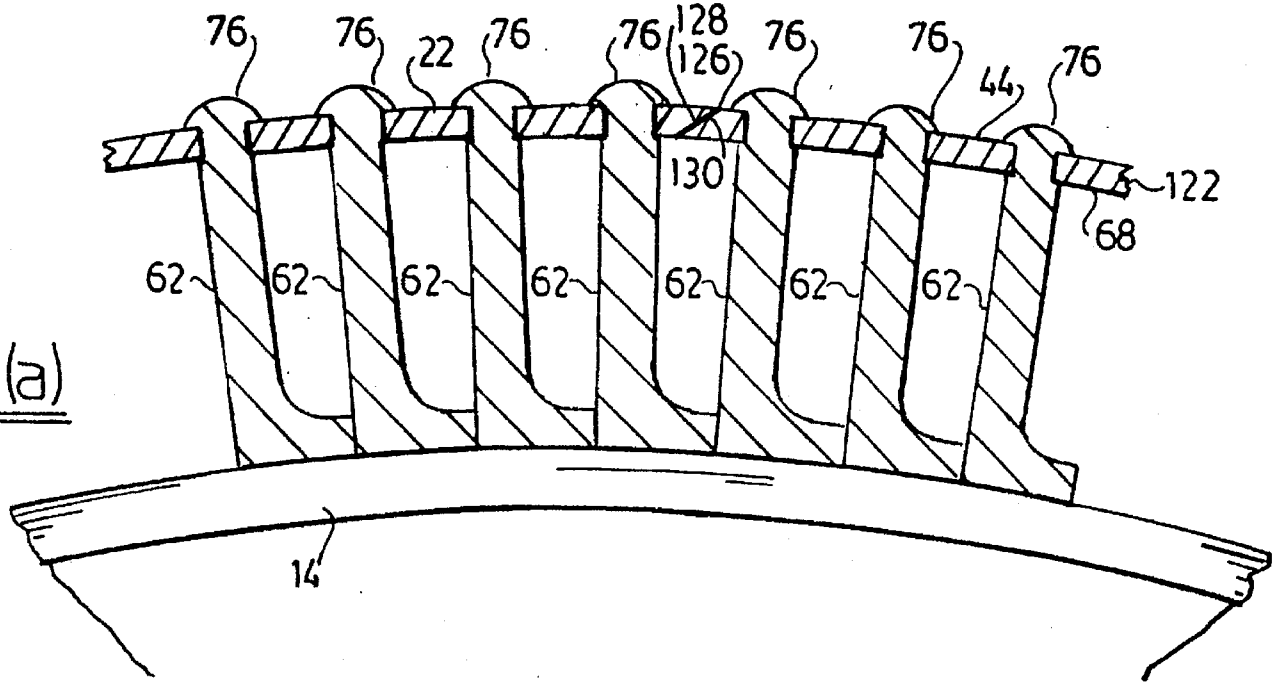
FIG. 4(*a*) is a partial cross-sectional view of a first rotor embodiment with a non-radial cut through opposing sides of the shroud band.
Figure 4B:
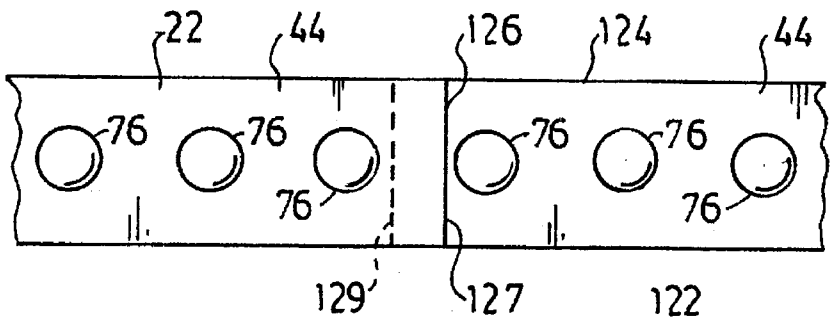
Figure 4C:
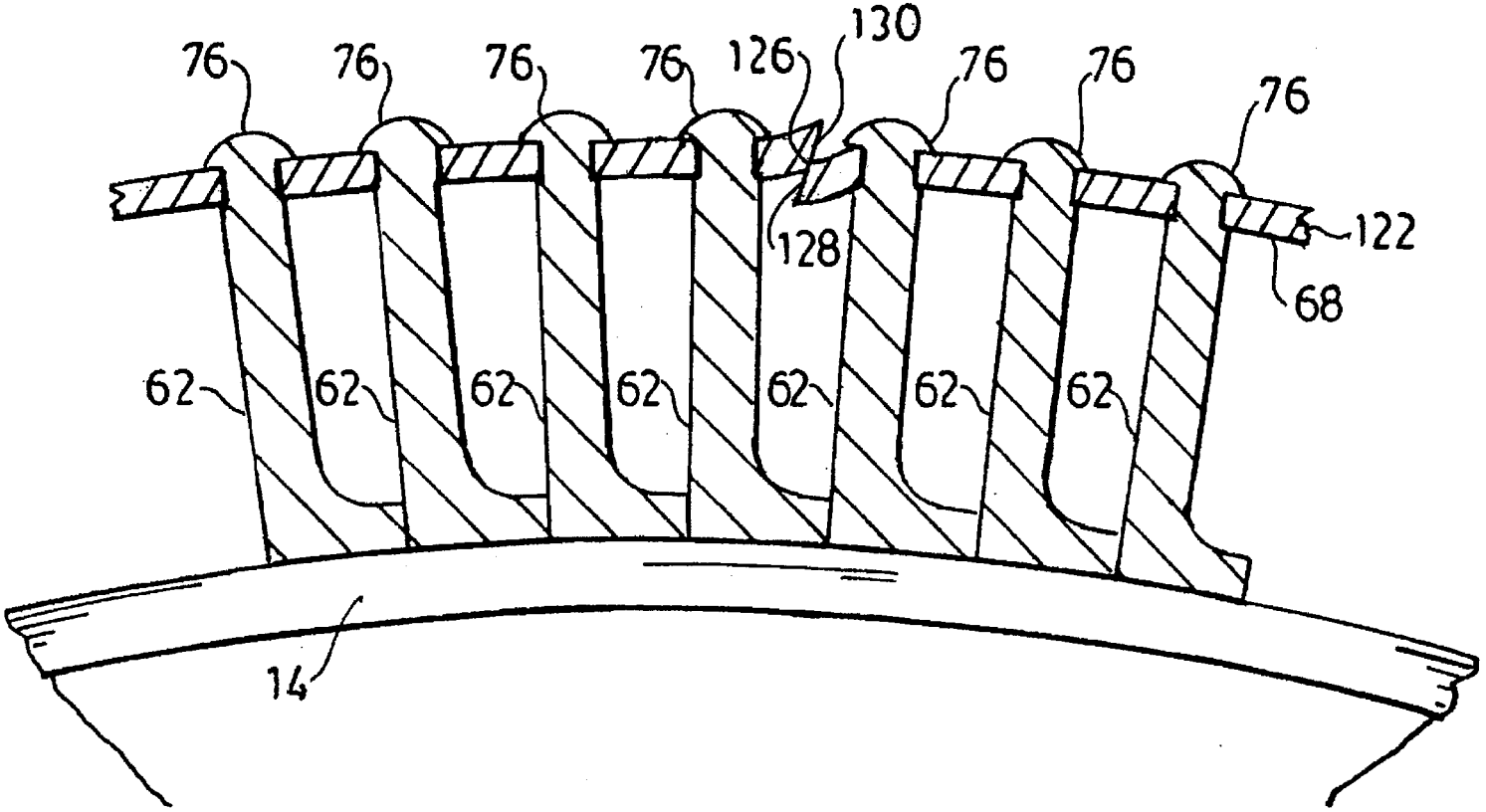
Figure 4D:
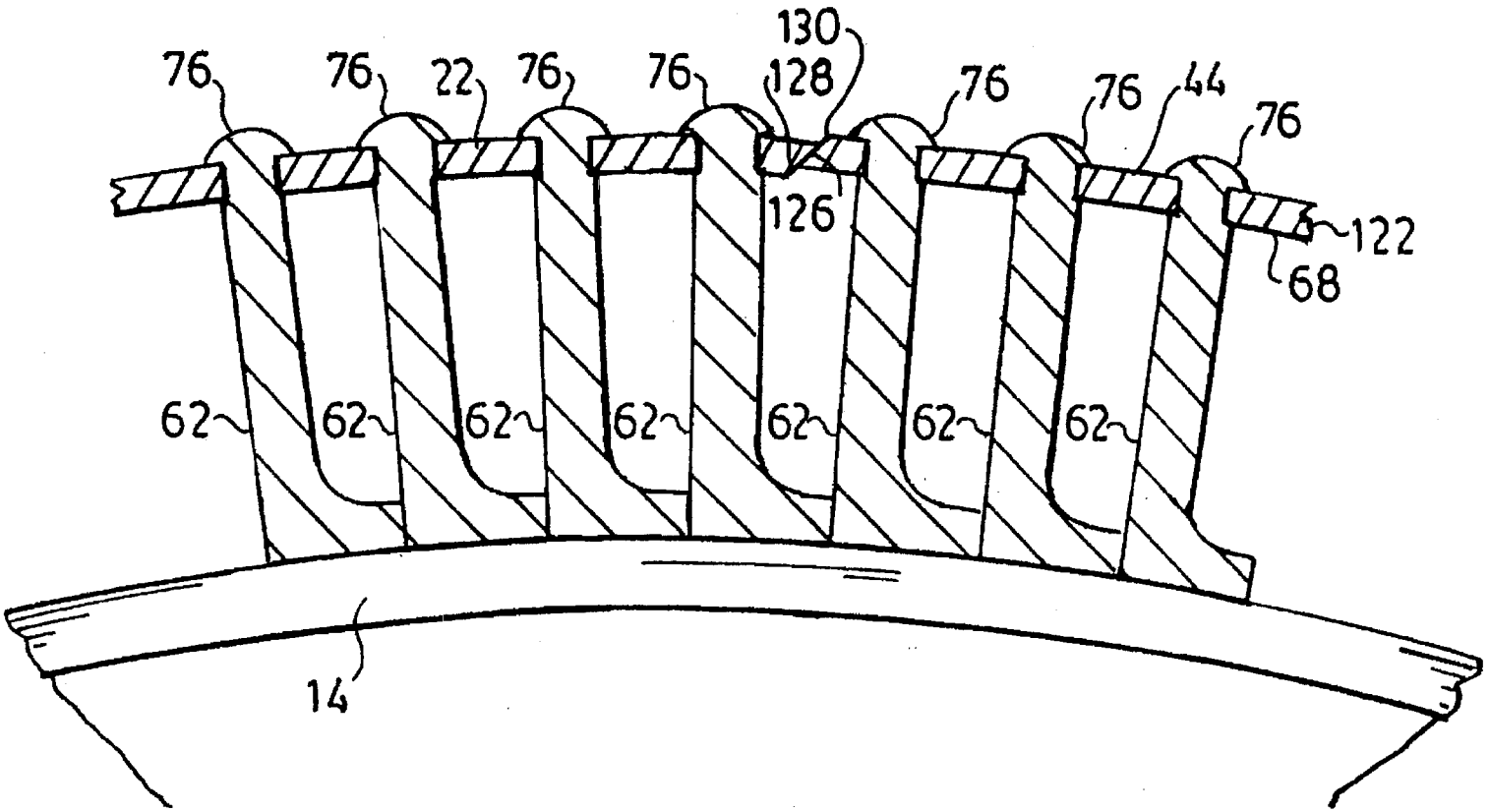
Figure 4E:
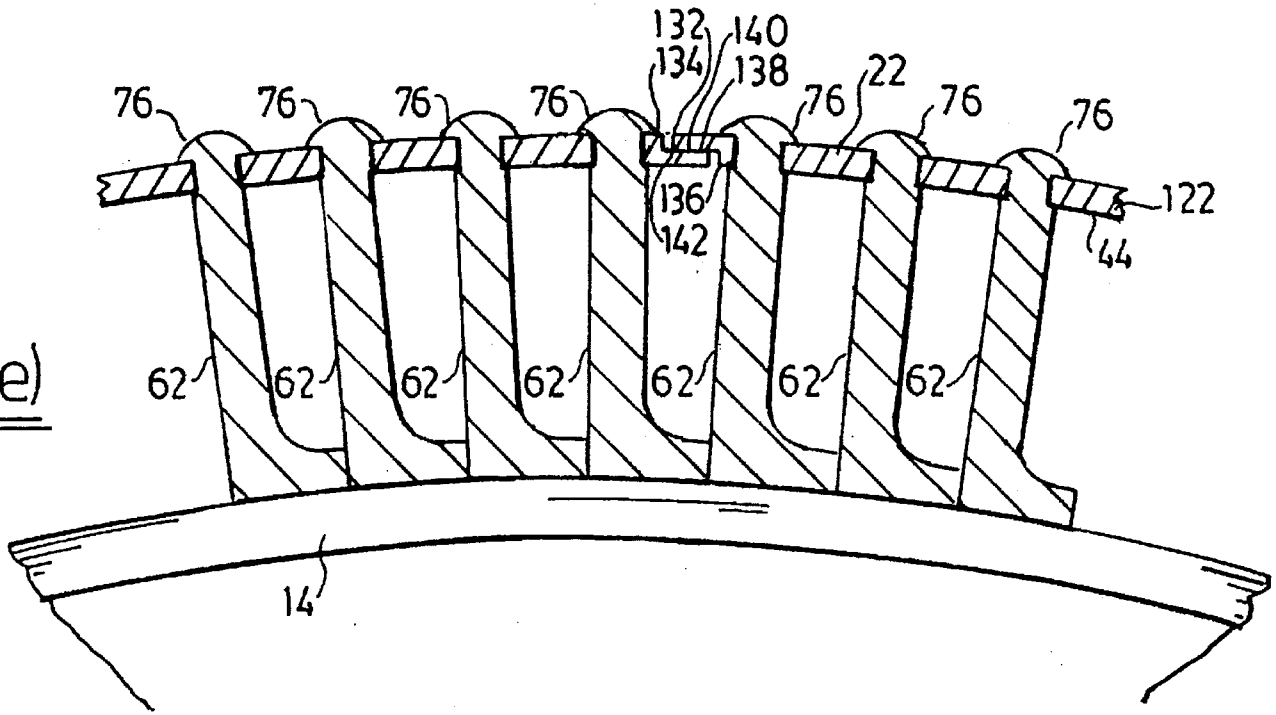
Figure 4F:
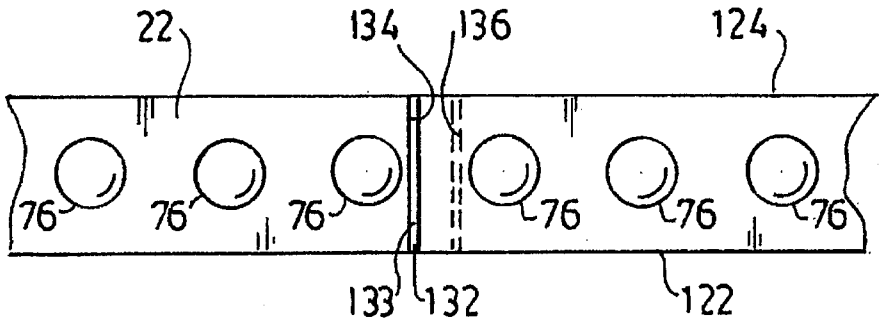
Figure 4G:
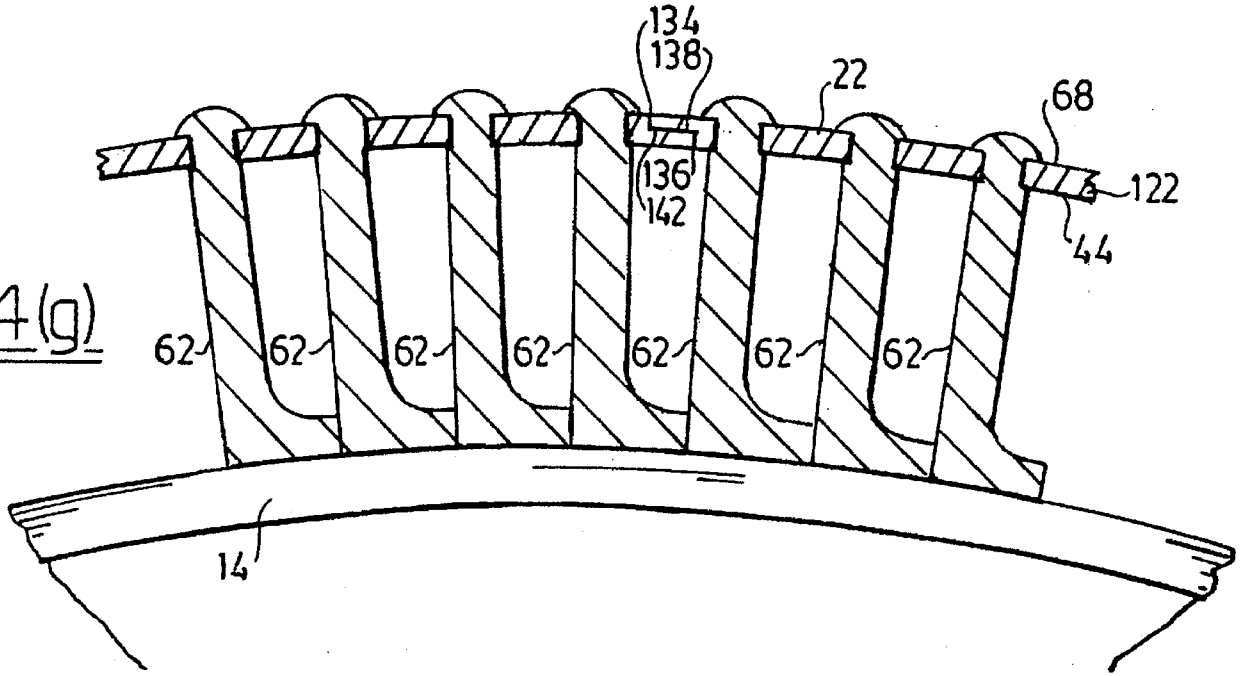
Figure 4H:
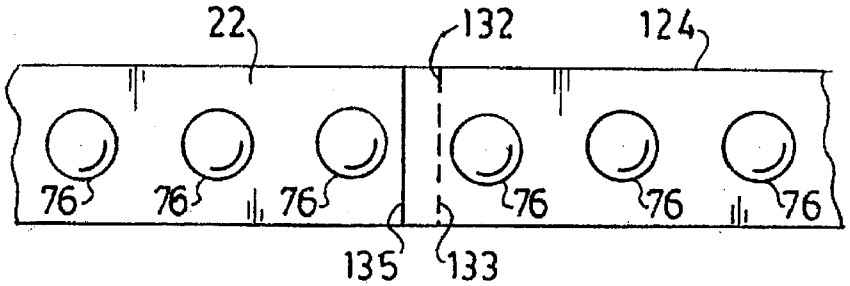
Figure 4I:
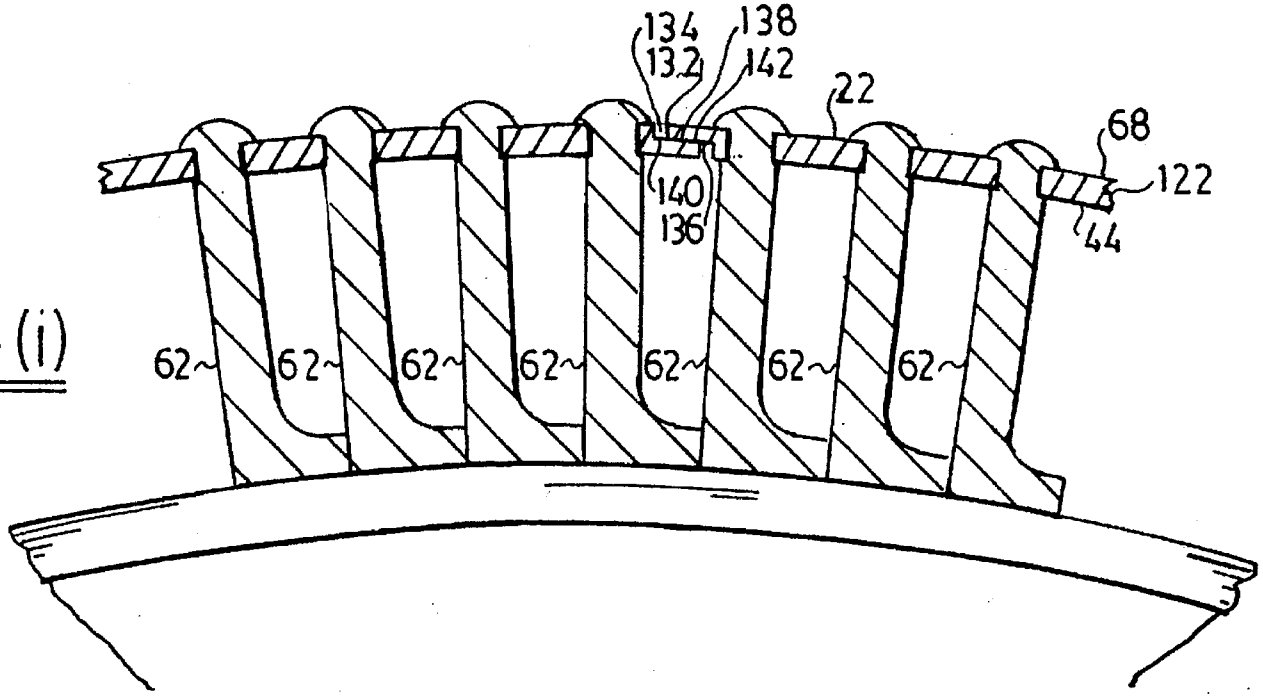
Figure 4J:
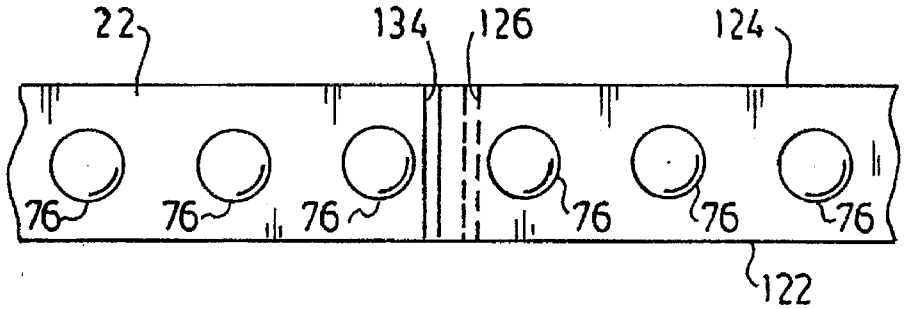

Referring to FIGS. 3(*a–i*), a simple manufacturing and installation process of shroud band 22 is illustrated. The blade-tip seals in turbo machine 10 produced by the process are cost effective because no special or costly techniques must be used to manufacture or install the shroud band used for this seal. The manufacture and installation of shroud bands 24, 26, and 28 is identical to shroud band 22 and thus is not shown again.

Referring to FIGS. 3(*a*) and (*b*), an opening 120 is made in the shroud band 22 to accommodate rivet 76 on bucket 62 of rotor wheel 14 and then opening 120 in shroud band 22 is placed over rivet 76. Referring to FIG. 3(*c*), shroud band 22 is seated over a number of rivets 76 to seal the top of all of the buckets 62 on rotor wheel 14.

Referring to FIGS. 3(*d*) and (*e*), once shroud band 22 is in place, then the head of rivet 76 is flattened with a hammer or other stamping device (not shown) to secure inner radial surface 68 of shroud band 22 against tips 63 of bucket 62. Shroud band 22 is thus secured to buckets 62 by a number of rivets 76, as shown in FIG. 3(*f*).

Referring to FIGS. 3(*g–i*), when all of the rivets 76 on rotor wheel 14 have been flattened, then a turning operation may be used to cut upstream and downstream portions 82 and 84 out of shroud band 22. The turning operation creates central portion 80 which is displaced radially outward from upstream and downstream portions 82 and 84. If additional non-contact axial seals are desired, a second turning operation could be performed on central portion 80 to make middle portion 81 as shown in FIGS. 2(*c–d*).

As shown, shroud band 22 is inexpensive to manufacture and easy to install. Only a simple rectangular cross-sectional piece is needed to create shroud band 22 and a simple turning operation makes central, upstream and downstream portions 80, 82, and 84. Thus it is shown that special techniques to manufacture shroud bands 22, 24, 26, and 28 are unnecessary.

Referring to FIG. 4(*a*), a cross-sectional view of a portion of rotor wheel 14 with buckets 62 and shroud band 22 is illustrated. Rotor wheels 16, 18, and 20 and shroud bands 24, 26, and 28 are identical to rotor wheel 14 and shroud band 22 and thus are not shown. As discussed in the background, shroud band 22, buckets 62, and rotor wheel 14 may not have the same rate of expansion when subject to a thermal transient. As a result, shroud band 22, buckets 62, and rotor wheel 14 may not expand uniformly and can be damaged, if compensation for the differing rates of thermal expansion is not provided for.

As shown in FIG. 4(*b*) a linear and non-radial cut 126 is made through opposing sides 122 and 124 (located between inner and outer radial surfaces 68 and 44) of shroud band 22 to compensate for thermal transients. Sides 128 and 130 of cut 126 remain in contact. Cut 126 is cut at an angle beginning at an entry point 127 and exiting at an exit point 129 (shown in phantom). Although only one cut 126 is shown in shroud band 22, shroud band 22 could have more than one cut 126 if desired.

Referring to FIG. 4(*c*), a partial side view of the first rotor embodiment in FIG. 4(*a*) during thermal a thermal transient where the shroud band 22 expands faster than the buckets 62 and the rotor wheel 14. Cut 126 allows shroud band 22 to slide along sides 128 and 130 to prevent damage to turbo machine 10 while always keeping sides 128 and 130 in contact to keep the fluid in the buckets 62. Accordingly, with cut 126, shroud band 22 compensates for uneven thermal expansion in turbo machine 10, thus maintaining the turbo machine's power and efficiency.

Referring to FIG. 4(*d*), the cut in 126 in shroud band 22 also compensates for a thermal transient where the shroud band 22 does not expand as fast as the buckets 62 and the rotor wheel 14. Shroud band 22 can slide radially along sides 128 and 130 to again damage to turbo machine 10 while always keeping sides 128 and 130 in contact.

Referring to FIG. 4(*e*), a partial cross-sectional view a second rotor embodiment with another cut through opposing sides of the shroud band is illustrated. In this embodiment, a cut 132 extends through opposing sides 122 of shroud band 22. Cut 132 has first and second linear portions 134 and 136 extending substantially radially inward and offset from inner and outer radial surfaces 68 and 44, respectively, and has a middle linear portion 138 connecting first and second linear portions 134 and 136 circumferentially. The sides 140 and 142 of cut 132 along middle linear portion 138 always remain in contact. As shown in FIG. 4(*f*), at steady state there is a small gap 133 in cut 132 near outer radial surface 44 and a small gap 135 in cut 132 near outer radial surface 68.

Referring to FIG. 4(*g*), another cross-sectional view of the portion of the rotor wheel 14 with buckets 62 and shroud band 22 is illustrated during a thermal transient where the shroud band 22 expands faster than the buckets 62 or the rotor wheel 14. During thermal expansion, sides 140 and 142 slide against each other, but remain in contact. As shown in FIG. 4(*h*), the gaps 133 and 135 in cut 132 are closed by the expansion.

Referring to FIG. 4(*i*), another cross-sectional view of the portion of the rotor wheel 14 with buckets 62 and shroud band 22 is illustrated for the case when the shroud band 22 contracts relative to the buckets 62 and the rotor wheel 14. During contraction, sides 140 and 142 again slide against each other, but remain in contact. As shown in FIG. 4(*j*), the gaps 133 and 135 during contraction become larger than at steady state.

Having thus described the basic concept of the invention, it will be readily apparent to those skilled in the art that the foregoing detailed disclosure is intended to be presented by way of example only, and is not limiting. Various alterations, improvements and modifications will occur and are intended to those skilled in the art, though not expressly stated herein. These modifications, alterations, and improvements are intended to be suggested hereby, and are within the sphere and scope of the invention. Accordingly, the invention is limited only by the following claims and equivalents thereto.

What is claimed is:

1. A turbo machine comprising:

a shaft which extends along and rotates about a central axis;

one or more rotor wheels mounted on and extending radially outward from the central axis to a radially outermost periphery;

a plurality of buckets arrayed circumferentially around each of said rotor wheels at the radially outermost periphery;

a shroud band for each of said rotor wheels having an inner radial surface secured to the radially outermost periphery of each said bucket on each of said rotor wheels, said shroud band having an outer radial surface with a central portion displaced radially outward from first upstream and first downstream portions of said radial outward surface, said central portion having a pair of opposing side surfaces;

one or more diaphragms extending radially inward from an outer casing, said outer casing surrounding said rotor wheels and said diaphragms each of said diaphragms axially spaced from one of said rotor wheels and configured to direct fluid against and effect rotation of said rotor wheel;

an extension for each said shroud band surrounding and radially spaced from said outer radial surface of said shroud band; and first and second seal teeth each extending radially inward from said extension for each said shroud band and terminating at tips below said outer radial surface of said central portion and adjacent to said opposing side surfaces of said central portion, respectively, and the tips of said first and second seal teeth extending radially inward of and axially spaced from first upstream and downstream portions of said central portion to form first and second non-contact axial seals, respectively.

2. The turbo machine according to claim 1 further comprising:

a third seal tooth extending radially inward from said extension and terminating at a tip which extends radially inward of and axially spaced from a downstream edge of said shroud band to form a third non-contact axial seal, and wherein said shroud band has an upstream edge axially spaced from each said diaphragm to form each a fourth non-contact axial seal.

3. The turbo machine according to claim 2 wherein the tip of said first seal tooth is axially spaced a first axial distance from said central portion, the tip of said second seal tooth is axially spaced a second axial distance from said central portion, said third seal tooth is axially spaced a third axial distance from said downstream edge, and said upstream edge is axially spaced a fourth axial distance from said diaphragm, so that an increase in the first and fourth axial distance is compensated for by a corresponding decrease in the second and third axial distance and an increase in the second and third axial distance is compensated for by a corresponding decrease in the first and fourth axial distance.

4. The turbo machine according to claim 3 wherein the tip of said first seal tooth and the upstream edge are positioned so that said first and fourth axial distances are substantially the same and the tips of said second and third seal teeth are positioned so that said second and third axial distances are substantially the same.

5. The turbo machine according to claim 4 wherein the tips of said first and second seal teeth are radially spaced a first and second radial distance from the upstream and downstream portions to form first and second non-contact radial seals and the first and second radial distances are substantially the same.

6. The turbo machine according to claim 1 wherein each said diaphragm has a plurality of nozzles attached and evenly spaced around each said diaphragm to direct fluid against said buckets.

7. The turbo machine according to claim 6 further comprising rivets to secure each said shroud band to the tips of each of the buckets.

8. The turbo machine according to claim 1 wherein each said shroud band has a pair of opposing sides between the inner and outer radial surfaces of each said shroud band and having at least one non-radial cut extending through each said shroud band so that the opposing sides of said cut remain in contact during expansion or contraction of said shroud band.

9. The turbo machine according to claim 8 wherein said cut is linear and non-radial.

10. The turbo machine according to claim 1 wherein said extension is secured to said diaphragm.

11. A turbo machine comprising:

a shaft which extends along and rotates about a central axis;

one or more rotor wheels mounted on and extending radially outward from the central axis to a radially outermost periphery;

a plurality of buckets arrayed circumferentially around each of said rotor wheels at the radially outermost periphery;

a shroud band for each of said one or more rotor wheels having an inner radial surface secured to the radially outermost periphery of said buckets for each of said rotor wheels, said shroud band having an outer radial surface with a central portion displaced radially outward from first upstream and first downstream portions of said radial outward surface;

one or more diaphragms extending radially inward from an outer casing, said outer casing surrounding said rotor wheels and said diaphragms, each of said diaphragms axially spaced from one of said rotor wheels and configured to direct fluid against and effect rotation of each said rotor wheel;

an extension from each said diaphragm surrounding and radially spaced from said outer radial surface of said shroud band;

first and second seal teeth each extending radially inward from each said extension and terminating at tips adjacent to said upstream and downstream portions, respectively, and the tips of said first and second seal teeth extending radially inward of and axially spaced from said central portion to form first and second non-contact axial seals, respectively; and a third seal tooth extending radially inward from each said extension and terminating at a tip which extends radially inward of and axially spaced from a downstream edge of said shroud band to form a third non-contact axial seal.

12. The turbo machine according to claim 11 wherein the tip of said first seal tooth is axially spaced a first axial distance from said central portion, the tip of said second seal tooth is axially spaced a second axial distance from said central portion, and said third seal tooth is axially spaced a third axial distance from said downstream edge so that an increase in the first axial distance is compensated for by a corresponding decrease in the second and third axial distance and an increase in the second and third axial distances is compensated for by a corresponding decrease in the first axial distance.

13. The turbo machine according to claim 11 wherein said first and second seal teeth are radially spaced a first and second radial distance from the upstream and downstream portions and the first and second radial distances are substantially the same.

14. The turbo machine according to claim 11 wherein said extension is secured to said diaphragm.

15. A turbo machine comprising:

a shaft which extends along and rotates around a central axis;

one or more rotor wheels mounted on and extending radially outward from the central axis to a radially outermost periphery;

a shroud band for each of said one or more rotor wheels having an inner radial surface secured to the radially outermost periphery of said one or more rotor wheels, said shroud band adapted to provide for thermal expansion requirements of the turbo machine wherein each said shroud band has a pair of opposing sides between the inner and outer radial surfaces and has at least one non-radial cut extending through the opposing sides of said one or more shroud bands, so that the opposing sides of said cut remaining in contact during expansion or contraction of said shroud band.

16. The turbo machine according to claim 15 wherein each said cut is linear and non-radial.

17. The turbo machine according to claim 16 wherein each of said rotor wheels includes a plurality of buckets attached to and evenly spaced around each of said rotor wheels so that each of said buckets has radially outermost tips located along the radially outermost periphery of each of said rotor wheels.

* * * * *